US005886480A

United States Patent [19]

Penzenstadler et al.

[11] Patent Number: 5,886,480

[45] Date of Patent: Mar. 23, 1999

[54] POWER SUPPLY FOR A DIFFICULT TO START ELECTRODELESS LAMP

[75] Inventors: Ernest G. Penzenstadler, Herndon, Va.; Jerome D. Frank, Bethesda, Md.

[73] Assignee: Fusion UV Systems, Inc., Gaithersburg, Md.

[21] Appl. No.: 56,792

[22] Filed: Apr. 8, 1998

[51] Int. Cl.[6] ..... H05B 41/16

[52] U.S. Cl. ..... 315/248; 315/39; 315/307; 315/106

[58] Field of Search ..... 315/248, 39, 344, 315/106, 101, 105, 107, 307; 219/717, 718, 702, 721; 363/21, 28, 100

[56] References Cited

U.S. PATENT DOCUMENTS 3,780,252 12/1973 Crapuchettes ..... 219/10.55
4,620,078 10/1986 Smith ..... 315/106 X
4,633,140 12/1986 Lynch et al. ..... 315/248
5,571,439 11/1996 Daley et al. ..... 315/106 X
5,773,918 6/1998 Dolan et al. ..... 315/248 X

*Primary Examiner*—Don Wong
*Assistant Examiner*—Haissa Philogene
*Attorney, Agent, or Firm*—Shlesinger, Arkwright, & Garvey LLP

[57] ABSTRACT

A power supply for an electrodeless lamp having an exterior starting electrode and first and second magnetrons coupled to the lamp comprises first and second power sources for being connected to the respective first and second magnetrons; a switch having first and second positions, the first position for disconnecting the second power source from the second magnetron and connecting the output of the second power source to the output of the first power source such that they are added together for being connected to the first magnetron during starting of the lamp, the second position for disconnecting the second power source from the first magnetron and connecting the second power source to the second magnetron after the lamp has started; and a controller adapted to synchronize the starting of the first and second power sources and the starting electrode such that they are turned on at the same time during starting of the lamp.

18 Claims, 3 Drawing Sheets

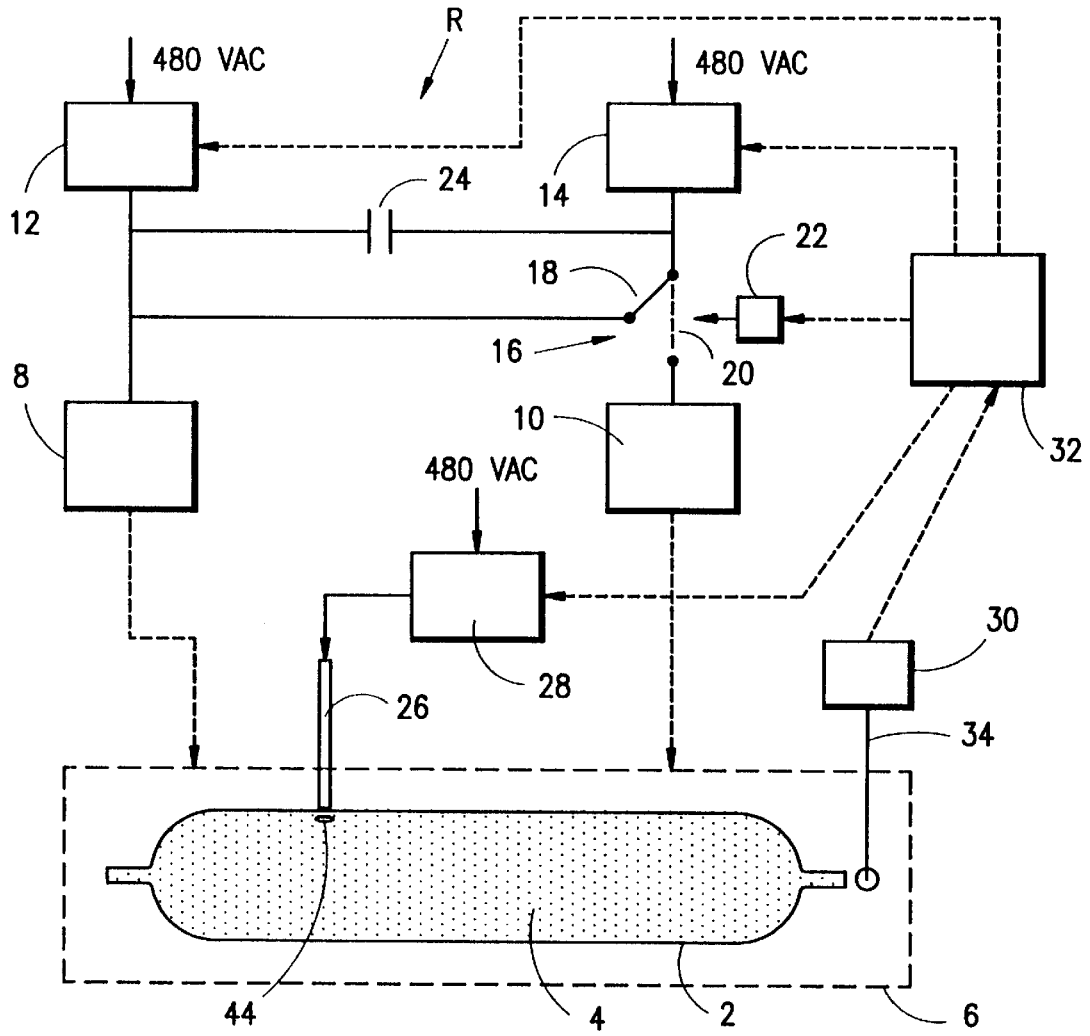
FIG. 1
FIG. 2A
FIG. 2B
FIG. 2C
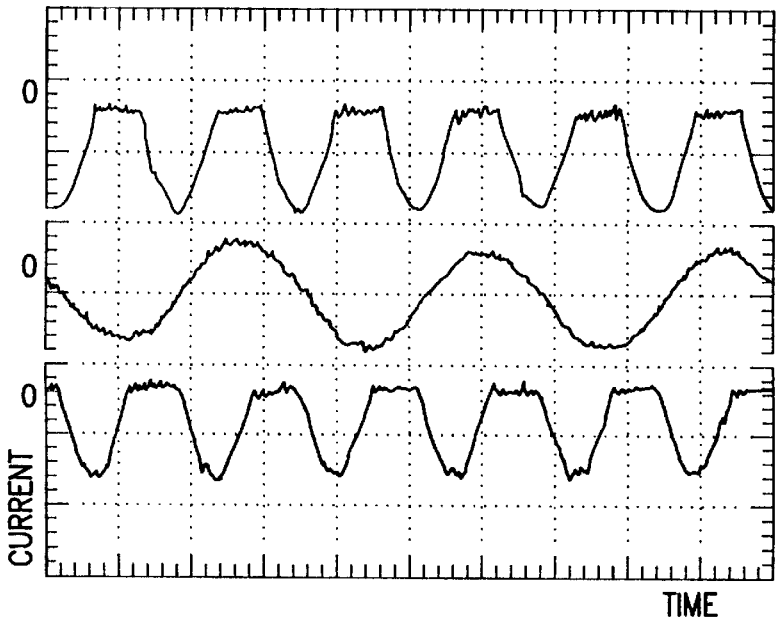

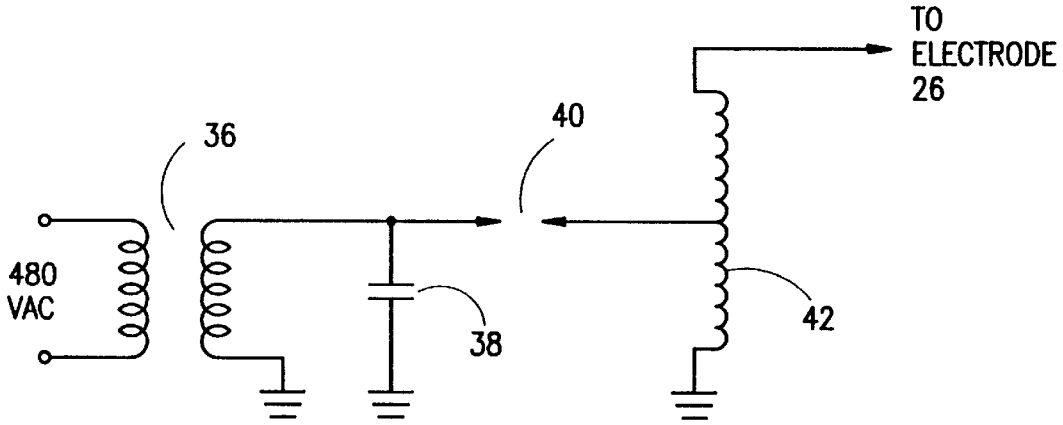
FIG. 3
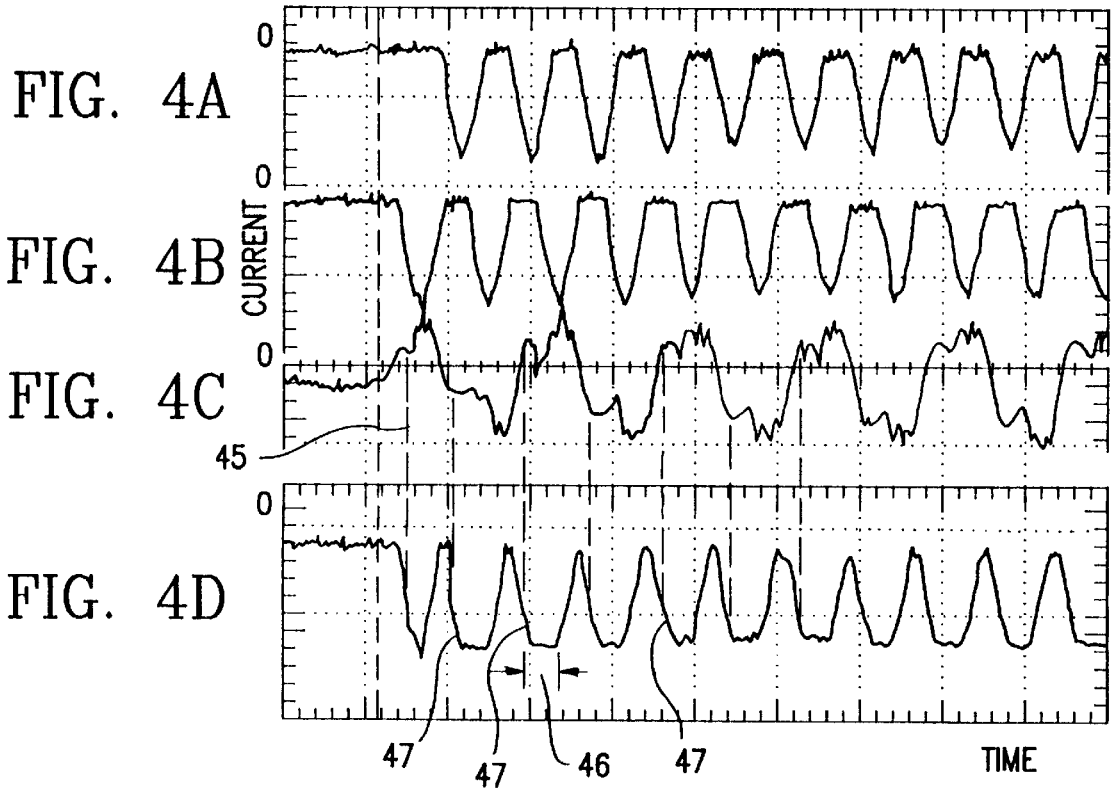

POWER SUPPLY FOR A DIFFICULT TO START ELECTRODELESS LAMP

FIELD OF THE INVENTION

The present invention relates generally to electrodeless lamps that contain high pressure and/or electronegative fills and in particular to a power supply that provides an output sufficient to start a difficult to start electrodeless lamp.

BACKGROUND OF THE INVENTION

The present application is related to a co-pending patent application, entitled "Method and Apparatus for Starting Difficult to Start Electrodeless Lamps," Ser. No. 08/696,706, which is hereby incorporated by reference.

Electrodeless lamps with quiescent fill pressures in excess of one atmosphere of pressure and/or electronegative fill constituents are typically difficult to start. Both high pressure and electronegative fill additives provide mechanisms that suppress the growth of the free electron population. A certain local density of these free electrons is crucial for a successful bulb ignition event. In order to overcome the ignition inhibition mechanisms, one typically increases the amplitude of whatever mode of excitation that one is using. In electrodeless lamps, the pitfall in this approach appears when the electric field strength required to ionize the bulb fill exceeds the Paschen parameter of the air and structure surrounding the bulb. In this case, all microwave or RF energy is delivered to an arc, which prevents the bulb from igniting and can destroy the lamp.

U.S. Pat. No. 5,571,439 discloses a variable power supply for a magnetron used in heating applications. The power supply includes two identical power units supplied from a three-phase AC main line. Each power unit is connected to a magnetron whose microwave output is coupled to an ultraviolet lamp through a wave-guide connected to a microwave cavity in which the lamp is secured. The lamp is used for curing purposes, such as in a printing application. In an electrodeless lamp, the microwave is coupled to a discharge forming fill disposed inside an envelope. The envelope contains a field or secondary electron emission substance disposed on a given region of the inside wall of the envelope. An exterior high voltage electrode is brought in contact with the envelope adjacent the given region containing the starting substance. The power sources and the electrode are energized to start the lamp. The electrode is then withdrawn away from the envelope after starting.

Applicants found that starting a hard to start lamp using the prior art power supply had been unreliable. At times, the lamp would start on a first attempt. At other times, several attempts would be required before the lamp would start. Applicants found that the high voltage impulse delivered to the field or secondary emission substance must be reliably applied near the peak of the magnetron current. Further, both magnetrons must be phased so that a period of high electric field is created of sufficient duration that the free electron population achieves the requisite local density for ignition. The extant state of the art power supplies did not satisfy these requirements resulting in unreliable lamp starting.

OBJECTS AND SUMMARY OF THE INVENTION

It is an object of the present invention to provide a power supply for an electrodeless lamp that would provide the required power output for reliable starting of the lamp each time.

It is also an object of the present invention to provide a power supply for an electrodeless lamp that synchronizes the available power source to provide the requisite power level for starting the lamp.

In summary, the present invention provides a multi-channel power supply for an electrodeless lamp. The lamp is comprised of first and second magnetrons, each powered by an independent power supply channel, coupled to a common microwave cavity wherein the bulb resides; a switch having first and second positions, the first position for disconnecting the output of the second power source from the second magnetron and placing the second power source in parallel with the first power source during lamp starting, the second position for disconnecting the second power source from the first magnetron and connecting the second power source to the second magnetron after the lamp has started; and a controller adapted to synchronize the starting of the first and second power sources and the starting electrode power supply such that they are turned on at the same time during starting of the lamp.

The present invention also provides a method for starting a microwave powered electrodeless lamp, comprising the steps of providing a capacitively coupled starting electrode connected to a high voltage power source; providing first and second power sources connected to respective first and second microwave sources; connecting the first and second power source to the first microwave source for starting and disconnecting the second power source from the second microwave source such that the output of the first and second power sources are combined; energizing the first and second power sources and the high voltage source at the same time; turning off the high voltage source to the starting electrode; withdrawing the electrode away from the envelope; and disconnecting the first and second power sources from each other and connecting the second power source to the second microwave source.

These and other objects of the present invention will become apparent from the following detailed description.

BRIEF DESCRIPTIONS OF THE DRAWINGS

FIG. 1 is a schematic diagram of an electrodeless lamp utilizing a power supply made in accordance with the present invention.

FIGS. 2A and 2C are current output plots of a pair of power sources connected to respective magnetrons.

FIG. 2B is a power input plot of a line power source connected to a starting electrode power supply.

FIG. 3 is a schematic diagram of the high voltage power source for the starting electrode used in the present invention.

FIGS. 4A and 4B are current output plots of a pair of power sources during starting of the lamp.

FIG. 4C is the plot of FIG. 2B showing the distortion caused by firing of a spark gap switch during starting of the lamp.

FIG. 4D is a plot of the combined waveforms of FIGS. 4A and 4B, used during starting of the lamp.

DETAILED DESCRIPTION OF THE INVENTION

Figure 5:
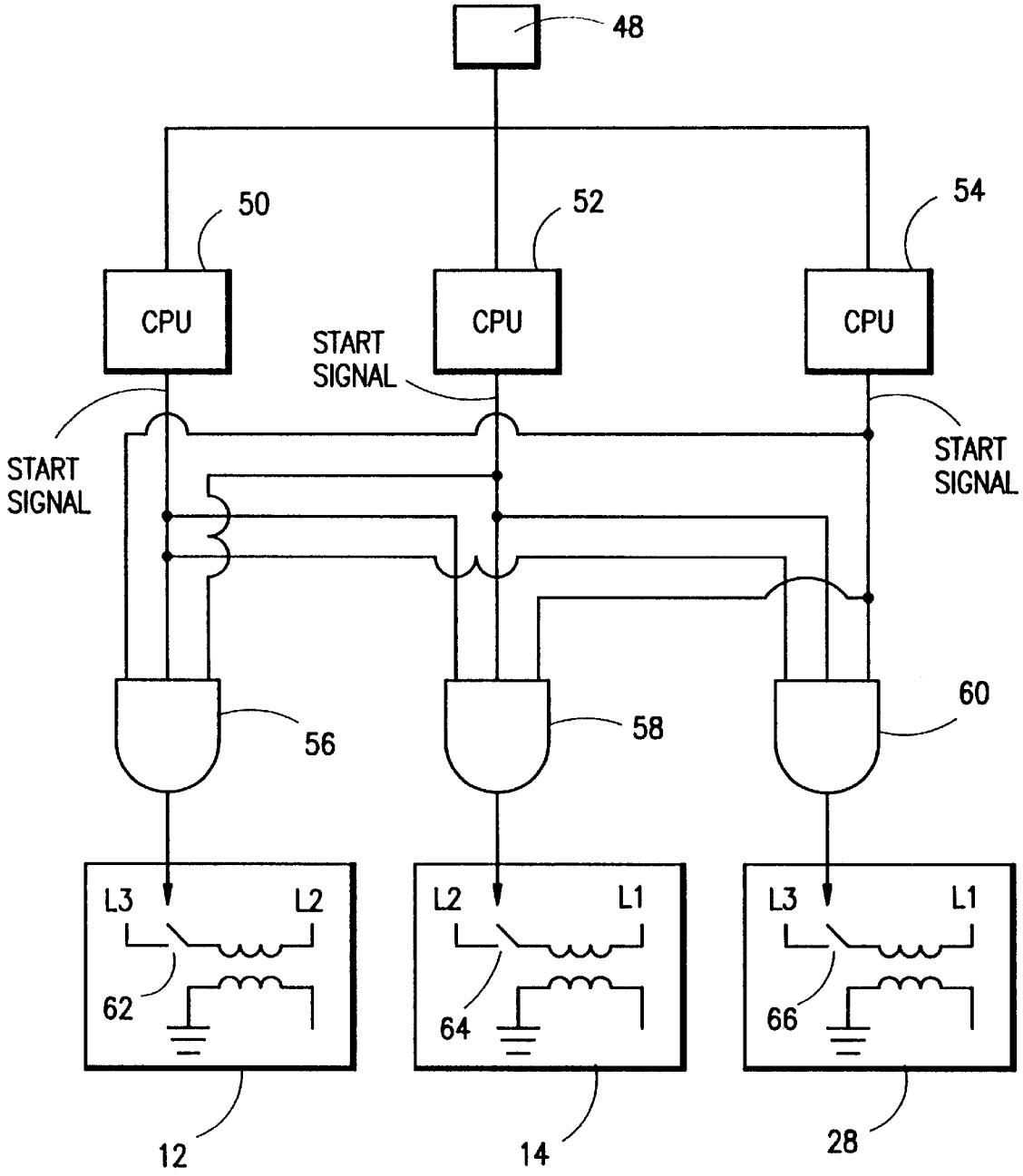
FIG. 5 is schematic diagram of a control scheme for synchronizing the starting of several power sources.

An electrodeless lamp R made in accordance with the present invention is disclosed schematically in FIG. 1. The lamp includes an envelope 2 with a plasma fill 4. The envelope 2 is disposed within a microwave cavity 6. First and second microwave sources or magnetrons 8 and 10 are operably coupled via wave-guides to the respective opposite ends of the microwave cavity to sustain a discharge from the fill 4. First and second variable power sources 12 and 14 generate DC power and are operably connected to respective magnetrons 8 and 10. Each power source includes a step-up transformer to provide a high-voltage output required by the magnetrons, typically 4.8 kv and 880 mA. The power sources 12 and 14 are disclosed in U.S. Pat. No. 5,571,439. A high-voltage single pole double throw relay 16 in its start position 18 switches the output of the power source 14 to the magnetron 8 during start-up of the lamp, thereby providing the magnetron 8 with the combined output of the power sources 8 and 14. After successful start-up of the lamp, the relay 16 is switched to its run position 20 to reconnect the power source 14 to the magnetron 10. A timer 22 provides a preselected time, approximately 1280 ms, during which the relay is held in the start position. A capacitor 24 is connected across the relay 16 to advantageously absorb the energy stored in the transformers of the power sources 12 and 14 during commutation of the relay. The power sources 12 and 14 are connected to a three-phase power supply, preferably 480 VAC.

A high-voltage starting electrode 26 is disposed adjacent to one end of the envelope 2, which is coupled to the magnetron 8 that receives the combined output of the power sources 12 and 14 during start-up. When the lamp is started, the electrode 26 is brought into the microwave cavity 6 and in contact with the envelope wall, energized for 300 ms, and then retracted away from the envelope 2 and outside the microwave cavity 6. The electrode 26 remains outside of the microwave cavity while the lamp is operating after a successful start. A high-voltage source 28 is operably connected to the starting electrode 26. Co-pending application Ser. No. 08/696,706 discloses the starting electrode 18 in further detail, and is hereby incorporated by reference.

FIGS. 2A and 2C show the current waveforms of the outputs of the power sources 12 and 14, respectively. The outputs are full-wave rectified using standard phase-controlled SCRs. The waveforms are 120° phase shifted, since the line power is standard commercial 60 or 50 Hz three-phase AC.

FIG. 2B shows the line input to the electrode power source 28.

A photocell 30 monitors the presence of light being transmitted from within the envelope 2 approximately after 1280 ms from start-up. If the lamp is not successfully started, the absence of light will cause the photocell 30 to generate a signal to a controller 32 to turn off the power sources 12 and 14. If the lamp is successfully started, the photocell 32 will continue to monitor the presence of light being transmitted from the envelope 2 and provide a signal that the bulb is lit. If the bulb extinguishes, the photocell will provide a signal to the controller to turn off the power sources 12 and 14. A fiber-optic cable 34 transmits light from the end of the envelope to photocell 32. Co-pending application Ser. No. 08/840,709, filed Apr. 25, 1997, discloses the photocell arrangement, and is hereby incorporated by reference.

The high voltage power source 28 is disclosed in greater detail in FIG. 3. A transformer 36 raises the supply voltage to about 10 Kv to charge a capacitor 38. A spark gap switch 40 closes at a certain voltage near the positive and negative peaks of the sinusoidal input power, discharging the capacitor 38 to an auto-transformer 42, which is connected to the starting electrode 26. The auto-transformer resonates around 2 Mhz to generate an impulsive output of about 80 Kv, lasting about 1 $\mu$s (microsecond) at a 120 Hz rate.

The controller 32 is operably coupled to the power sources 12 and 14, and the photocell 32. The controller 32 provides for the synchronous starting of the power sources 12 and 14 so that each will start at the same time, 120° phase-shifted, as best shown in FIGS. 4A and 4B. The controller 32 also provides for turning the power supply 28 to the electrode 26 at the time of starting the power sources 12 and 14, so that the electrode 26 is energized when there is output power from the power sources 12 and 14, as best shown in FIG. 4C. The power sources 12 and 14 and the starting electrode 26 are thus advantageously synchronized during starting of the lamp, insuring that power is being supplied to the electrode only when there is power to the magnetrons to support the resulting plasma. Synchronization is critical for starting the lamp, as will be discussed below. Any internal delay imposed by the circuit architecture of the system is thereby eliminated.

In operation, the relay 16 is switched to its start position 18, connecting the output of the power source 14 to the magnetron 8. The power sources 12 and 14 are then activated through the controller 32 such that both come on line synchronously, phase-shifted by 120°, as best shown in FIGS. 4A and 4B. Neither power source will start until each one has received its start signal. The random delay caused by circuit architecture that causes one power source to come on line before the other one does is eliminated. Both power sources are forced to come on line together, separated only by the line phase shift of 120°. The outputs of power sources 12 and 14 are thus added up and connected to the magnetron 8, which is nearer to the starting electrode 26. The combined output of FIGS. 4A and 4B is shown in FIG. 4D. The high-voltage starting electrode 26 is brought in contact with the envelope 2 and the high voltage power source 28 is turned on at the same time as the power sources 12 and 14, as best shown in FIG. 4C. The electrode 26 is powered for approximately 300 ms, delivering a high voltage electric field to a field emission source 44, such as a compound containing cesium, potassium, rubidium, and sodium, as disclosed in co-pending application Ser. No. 08/696,706 cited above. The electrode 26 is energized at 120 Hz when the spark gap 40 breaks down, approximately at the positive and negative peaks of the high-voltage sinusoidal input power at the beginning or front edge of each cycle of the combined outputs of the power sources 12 and 14 to take full advantage of the energy of the combined output. Referring to FIGS. 4C and 4D, the discontinuities in the waveform of FIG. 4C are caused by the spark gap switch 40 discharging at the front edge of the negative peaks of the combined output waveform. Lines 45 illustrate the timing of the discharging of the spark gap for each half-cycle in respect to the combined power output. Note that each discharge occurs at the front edge of the combined output power, generally indicated at 47. The high electric field provided by the electrode 26 in conjunction with the microwave field causes electrons to be emitted from the field and/or secondary emission substance. These electrons, accelerated by the microwave field, cause further ionization events until the bulb fill 4 achieves the level of ionization required for normal operation. The broad negative peaks 46 of the combined power outputs provide greater "on" time for the magnetron 8 to increase the electron population in the envelope such that the plasma is not extinguished when the power output goes to zero in each cycle.

After approximately 300 ms, input power to the electrode power source 28 is deactivated and the electrode 26 is withdrawn away from the envelope 2 and out of the microwave cavity 6. Approximately 1 sec after the starting electrode 26 is withdrawn, the relay 16 is operated to disconnect the power source 14 from the magnetron 8 and to connect the power source 14 to the magnetron 10. The photocell 30 then starts monitoring the light coming from within the envelope 2. As soon as the photocell 30 detects light, the controller 32 turns the power output of the power supplies 12 and 14 to a pre-set operating level, up to 100%. If light is not detected, the power supplies 12 and 14 are shut down.

By connecting together the output of the power sources 12 and 14 and feeding the summed outputs to the magnetron 8, which is coupled to the end of the envelope closer to the high voltage starting electrode 26, the plasma is reliably initiated at that end, which then propagates across the envelope 2 to the other end.

The synchronization function of the controller 32 is illustrated in FIG. 5. A start button 48 is depressed to start the lamp. The start signal goes to respective controllers 50, 52 and 54 of the power supplies 12, 14 and 28. Respective AND gates 56, 58 and 60 are used to turn on respective power switches 62, 64 and 66 at the same time.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

We claim:

1. A power supply for an electrodeless lamp having an exterior starting electrode and first and second magnetrons coupled to the lamp, said power supply comprising:

a) first and second power sources for being connected to respective first and second magnetrons;

b) a switch having first and second positions, said first position for disconnecting said second power source from the second magnetron and connecting the output of said second power source to the output of said first power source such that they are added together for being connected to the first magnetron during starting of said lamp, said second position for disconnecting said second power source from the first magnetron and connecting said second power source to the second magnetron after said lamp has started; and c) a controller adapted to synchronize the starting of said first and second power sources and the starting electrode such that they are turned on at the same time during starting of the lamp.

2. A power supply as in claim 1, and further comprising:

a) a capacitor connected between the output of said first and second power sources.

3. A power supply as in claim 1, and further comprising:

a) a timer operably associated with said switch; and b) said timer being adapted to operate said switch to said second position after a pre-selected time.

4. An electrodeless lamp, comprising:

a) an envelope containing a fill;

b) a starting electrode disposed in close proximity to a given region of said envelope when the lamp is started;

c) first and second power sources connected to respective first and second excitation sources coupled to said fill to sustain a discharge;

d) a switch having first and second positions, said first position for disconnecting said second power source from said second excitation source and connecting the output of said second power source to the output of said first power source such that they are added together and coupled to said first excitation source during starting of said lamp, said second position for disconnecting said second power source from said first excitation source and connecting said second power source to said second excitation source after said lamp has started;

e) a high voltage power source operably connected to said electrode during starting of said lamp; and f) a controller adapted to synchronize said first, second and high voltage power sources such that they are turned on at the same time during starting of the lamp.

5. An electrodeless lamp as in claim 4, and further comprising:

a) a capacitor connected between the output of said first and second power sources.

6. An electrodeless lamp as in claim 4, and further comprising:

a) a timer operably associated with said switch; and b) said timer being adapted to operate said switch to said second position after a pre-selected time.

7. An electrodeless lamp as in claim 4, wherein:

a) said high voltage power source includes a spark gap switch.

8. An electrodeless lamp as in claim 7, wherein:

a) said high voltage power source includes an autotransformer connected to the output of said spark gap switch.

9. An electrodeless lamp as in claim 4, wherein:

a) said first and second excitation sources include microwave sources.

10. A method for starting a microwave powered electrodeless lamp, comprising the steps of:

a) providing a starting electrode connected to a high voltage power source;

b) providing first and second power sources connected to respective first and second microwave sources;

c) connecting the first and second power sources to the first microwave source and disconnecting the second power source from the second microwave source such that the output of the first and second power sources are combined;

d) energizing the first and second power sources and the high voltage source at the same time;

e) turning off the high voltage source to the starting electrode;

f) withdrawing the electrode away from the envelope; and g) disconnecting the first and second power sources from each other and connecting the second power source to the second microwave source.

11. A method as in claim 10, and further comprising the step of detecting light coming from the lamp after a preselected time.

12. A method as in claim 11, wherein the preselected time is approximately 1 sec.

13. A method as in claim 11, and further comprising the step of turning the first and second power sources off if light is not detected from the lamp.

14. A method as in claim 11, and further comprising the step of raising the power level of the first and second power supplies to a predetermined level if light is detected from the lamp.

15. A method as in claim 10, wherein the first and second power sources are energized at step d) at less than 100% power level.

16. A method as in claim 10, wherein the electrode is energized for approximately 300 ms.

17. A method as in claim 10, wherein the first and second power sources are connected together for approximately 1 sec.

18. A method as in claim 10, wherein the electrode is energized periodically at approximately the front edge of each cycle of the combined output of the first and second power sources.

* * * * *